United States Patent [19]

Prigent et al.

[11] Patent Number: 4,812,946

[45] Date of Patent: Mar. 14, 1989

[54] DEMAGNETIZATION AND EARTHING DEVICE FOR A PICTURE TUBE AND MACHINE FOR MANUFACTURING SAME

[75] Inventors: Georges Prigent, Versailles; Patrick Besnard; Jacques Dupaillon, both of Berd'Huis, all of France

[73] Assignee: U.S. Philips Corporation, New York, N.Y.

[21] Appl. No.: 107,073

[22] Filed: Oct. 8, 1987

[30] Foreign Application Priority Data

Oct. 10, 1986 [FR] France ..... 86 14125

[51] Int. Cl.[4] ..... H01F 13/00; H01H 47/00

[52] U.S. Cl. ..... 361/150; 315/8

[58] Field of Search ..... 361/150; 315/8

[56] References Cited

U.S. PATENT DOCUMENTS 4,441,052 4/1984 Willis ..... 315/8

4,700,260 10/1987 Craig et al. ..... 361/150

*Primary Examiner*—L. T. Hix

*Assistant Examiner*—David Porterfield

*Attorney, Agent, or Firm*—F. Brice Faller

[57] ABSTRACT

A device for demagnetization of the picture tube of a television receiver and earthing of the conductive coating applied to the cone of the tube includes a demagnetization coil system (4) constituted by a bundle of insulated electric wires held together and forming at least one loop applied to the cone of the tube. The wires of the strand are held together by a tape of plastic material wound helically around them, while a bare electric wire (1) is wound helically with the same pitch as the tape. This wire is connected to earth (15, 16).

5 Claims, 2 Drawing Sheets

DEMAGNETIZATION AND EARTHING DEVICE FOR A PICTURE TUBE AND MACHINE FOR MANUFACTURING SAME

BACKGROUND OF THE INVENTION

The invention relates to a device for the demagnetization of a picture tube of a television receiver and for earthing a conductive coating applied to the cone of the tube. The device includes a demagnetization coil system constituted by a bundle of electrically insulated wires held together and forming at least one loop applied to the cone of the tube as well as an electrical conductor connected to earth and arranged so as to be in electrical contact with the coating.

A device fulfilling this function and comprising the aforementioned elements is described, for example, in the German Utility Model No. 7030109. The device described in this document utilizes a metallic piece in the form of a spider, whose legs are fixed to gaps of the band of the picture tube by means of hooks and noses and are themselves provided with fingers for fixing the demagnetization coil as well as with recesses which permit of hooking a conductive tape for earthing provided with a tension spring.

This device comprises a mechanical support, whose cost price is added to that of the coil and of the earthing tape, while the mounting of the assembly requires hooking the legs and positioning the noses, then the coil and finally the tape and its spring.

SUMMARY OF THE INVENTION

The invention has for its object to provide a device, which in itself is inexpensive and whose positioning is considerably simplified. For this purpose, the device according to the invention is characterized in that the earthing conductor encloses the wire bundle of the demagnetization coil system. Thus, this conductor does not require any specific fixing member and does not require a specific mounting operation either; it is fixed simultaneously with the coil. Moreover, the contact between this conductor and the coating is ensured along several distinct lines in different regions of the coating, which reduces its electrical resistance.

In a preferred embodiment, in which the wires of the bundle are held together by a tape of plastic material helically wound around them, the conductor is advantageously a bare electric wire wound helically with the same pitch as the tape. Thus, it is possible to manufacture the coil system without the addition of the conductor requiring supplementary operations, while the cost price of the just-mentioned electric wire is substantially negligible.

In another embodiment, in which the wires of the bundle are held together by a sheath of plastic material enclosing them, the conductor is advantageously constituted by the sheath itself, which is made conductive at least at the surface.

Moreover, the device has an indirect advantage. The good isolation of the coil system connected to the mains is very important and standards provide for the testing of this isolation. Unfortunately, in order to carry out this test, an electrical contact surface has to be provided around the bundle; therefore, this test could be carried out according to the prior art only by taking samples at random at the expense of safety. With the device according to the invention, each coil system is provided with an earthing conductor enclosing it, while an isolation test over 100% of the members can be readily carried out.

In order to ensure without supplementary material and in a single operation that the coil is fixed, the earthing conductor is fixed and also the band of the tube is earthed, in the case of a tube intended to be fixed by means of ears with which it is provided, the bundle of the coil system provided with the earthing conductor advantageously passes in front of the ears and is fixed by only these means. Moreover, this affords the advantage of ensuring without supplementary means that the antiimplosion band of the tube is earthed. When the device is provided with a conductor for the electrical connection of the demagnetization coil, the conductor may advantageously be also connected to one of the terminals of the said conductor.

The invention also relates to a machine for manufacturing a demagnetization device according to the invention, by means of which the wire bundle of the demagnetization coil system is enveloped, this machine being provided with a rotatable magazine for supplying a tape of plastic material and winding it helically around the bundle, as well as advantageously with a second rotatable magazine taken along with the first magazine for supplying and winding a bare conductive wire in order to wind during one and the same winding operation the conductive wire and the tape of plastic material. Thus, only a slight increase of the investment with respect to the machine permits of obtaining a quasi gratuitous earthing means. For each television apparatus constructed, the price of an earthing bundle provided with a specific spring, of its fixing means and of the fixing operation itself is economized.

DETAILED DESCRIPTION OF THE PREFERRED EMBODIMENT

Figure 1:
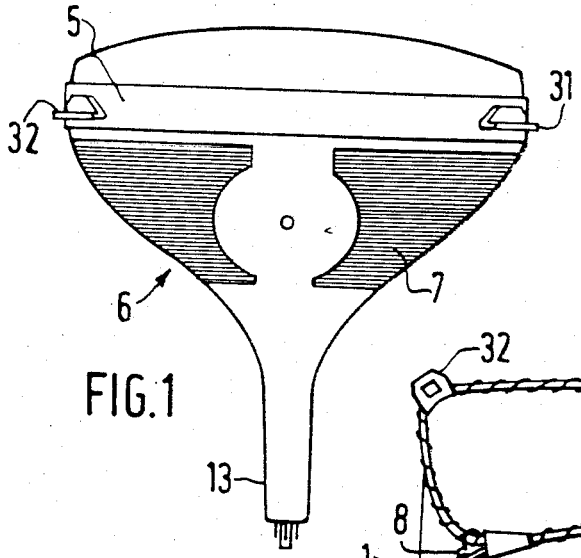
FIG. 1 shows in plan view a known picture tube.

The cathode-ray tube or picture tube shown in FIG. 1 is coated with a conductive coating 7, in general a graphite coating, on the major part of its cone 6. It is provided with a metallic anti-implosion band 5, which carries ears 31, 32, 33, 34 for fixing the tube. It must in addition be provided with a demagnetization coil system; this coil system comprises a plurality of insulated electrical wire turns constituting a bundle of wires held together, the whole resembling a kind of pipe which is applied to the cone 6 of the tube so as to form therein at least one loop.

Figure 2A:
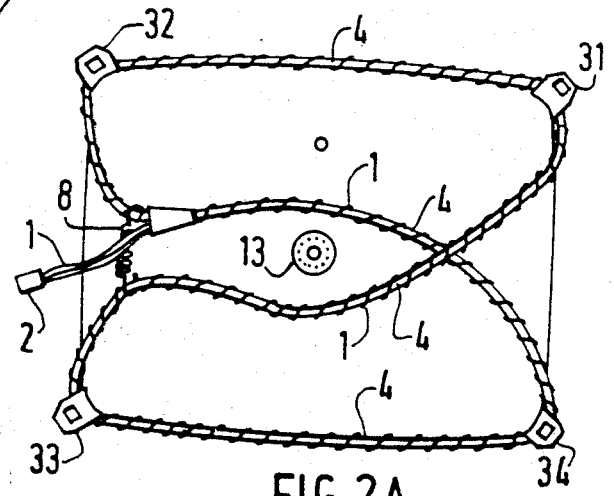
FIGS. 2A and 2B show in rear view a picture tube provided with a device according to the invention, FIGS. 3 and 4 each show variations of the bundle of the device according to the invention, of which they represent a section.

As shown in FIG. 2A, this pipe 4 can be arranged so as to form two loops, one of which is located on the upper half of the cone, while the other is located on the lower half thereof, the collar 13 of the tube not being included in a loop.

Figure 2B:
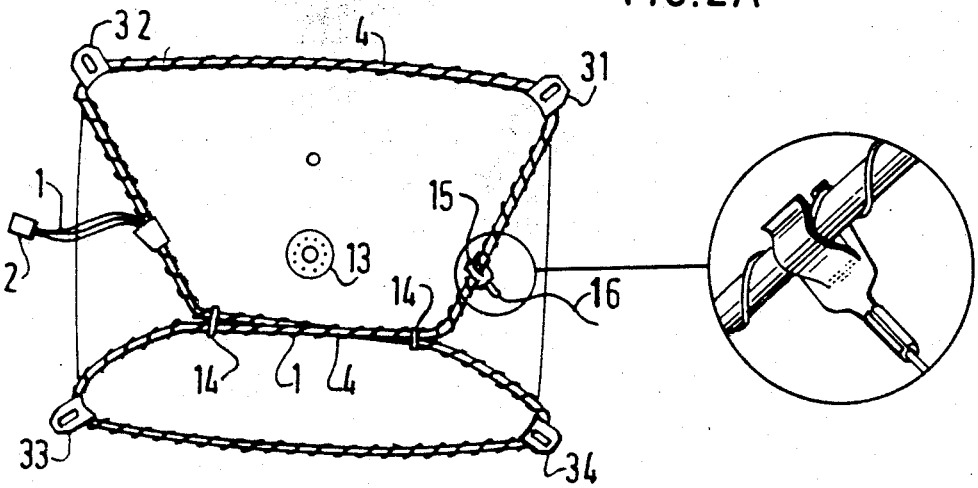

As shown in FIG. 2B, the pipe 4 can also be arranged so as to form two loops, the collar of the tube being included in one of the two loops, which is larger than the other.

Otherwise, an electrical conductor, in this case an electric bare wire 1, connected to earth is wound helically around the wire bundle 4.

The band 5 of the tube is thus provided with ears 31 to 34, which permit of fixing the tube in a cabinet or a chassis. The bundle 4 provided with the earthing conductor 1 passes in front of the ear 31 (the term "in front of" means: "on the side of the front face of the tube", that is to say behind the ear in the Figure), follows the band to the ear 32, in front of which it passes, traverses diagonally the cone to the ear 34, passes in front of the ear 34, passes along the band and passes in front of the ear 33, then traverses again diagonally the cone whilst passing under the collar 13 to the ear 31, in which the starting point of this description of the path of the bundle is located. Thus, the bundle is fixed to the tube 6 solely due to the fact that it passes in front of the ears. A spring 8 (FIG. 2A) drawing the two diagonal arms of the path towards each other ensures a tension of the coil system by which it is applied to the graphite-coated cone, which thus permits of obtaining an electrical contact between the wire 4 wound helically around the bundle and the graphite coating of the tube. Two rings 14 (FIG. 2B) formed from a notched belt with irreversible clamping can also ensure the tension of the coil system.

The coil system is provided with a connector 2, to which the ends of the insulated electrical wire are connected, which constitutes the coil system; it is interesting to utilize this connector to also connect thereto the earthing conductor 1, which provides a means for connecting this conductor to, for example, the mass of a chassis.

Figure 3:
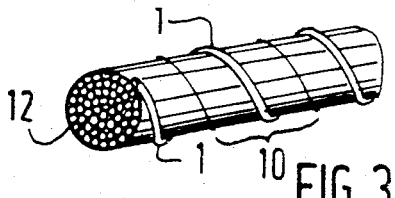

FIG. 3 shows a section of the bundle of FIGS. 2. The isolated conductive wires 12 are enclosed by a tape 10 of plastic material wound helically around them and holding them together. The conductor 1 is a bare electric wire, for example of galvanized copper, which is helically wound around the plastic tape 10. Moreover, it is advantageous for simplifying the manufacture of the assembly that this wire is wound with the same pitch as the tape 10.

Figure 4:
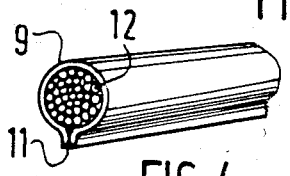

FIG. 4 shows a section according to another variation of a bundle according to the invention: the bundle of isolated conductive wires 12 is enclosed in this case by a sheath 9, which holds the wires of the bundle together; this cylindrical sheath of plastic material can be welded at 11 along a generatrix, for example by means of ultrasonic welding. According to the invention, this sheath is made of a material charged with conductive particles, or it is metallized at the surface. It is connected to earth by any known means, for example by providing an earthing wire 16 with elastic pincers 15 (FIG. 2B), which clamp the bundle at a point of its length, or by connecting the spring 8 of FIG. 2A to earth.

At least one connection means with earth of this kind always remains necessary, even in the case in which there is a wire 1 connected to the connector 2 because several masses have to be combined at the coating of the cone and it is necessary that they are taken to different points. (inter alia the mass of a "focus spark cap" situated near the neck of the picture tube need not be connected to the same point of the sheath of the strand as the other masses). For this purpose, metallic rings 14 may also be imagined, which would be provided with eyelets for connecting thereto an earthing wire of the kind of the wire 16.

Figure 5:
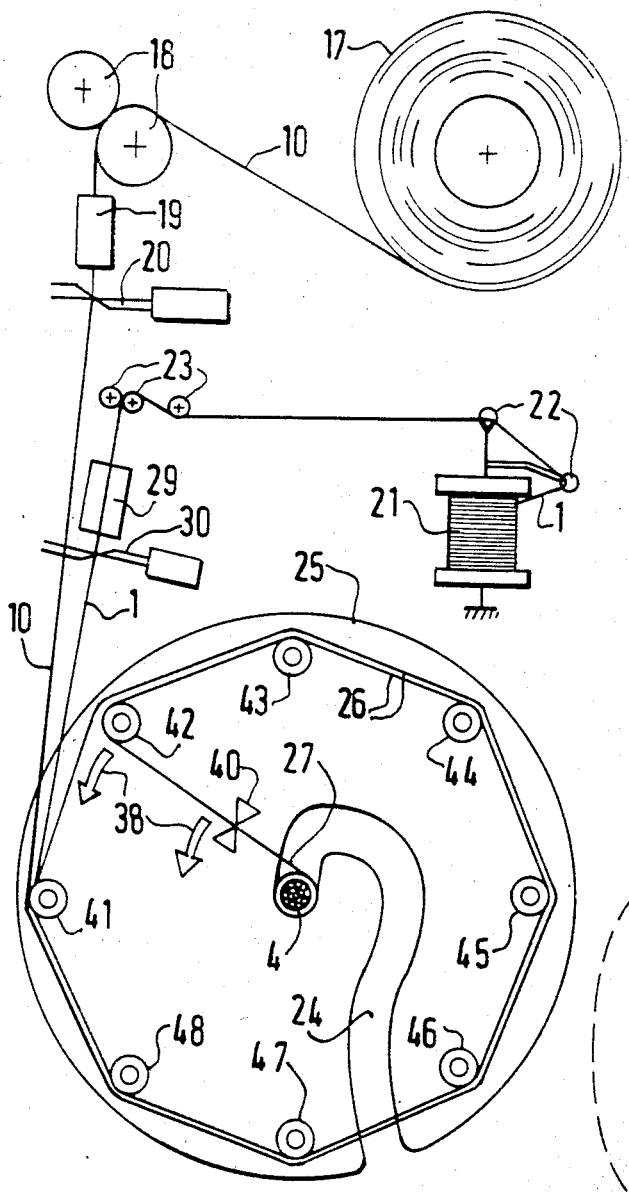
FIGS. 5 and 6 show very diagrammatically parts in accordance with the invention of a machine for enveloping a wire bundle.
Figure 6:
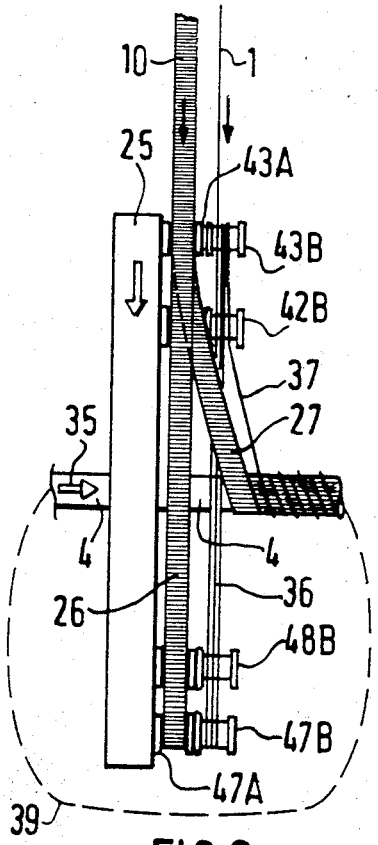

A machine for enveloping a bundle as shown in FIG. 3 is shown diagrammatically in FIGS. 5 and 6. In FIG. 5, a coil 17 supplies a tape 10, which is taken along and guided by pulleys 18 and then traverses an element 19 for measuring the supplied length and a cutting system 20. The tape is then positioned on a circular rotatable magazine 25 constituted by a wheel carrying near its rim a plurality of fly-wheel pulleys 41 to 48.

The coiled bundle 4 to be enveloped traverses the magazine at its centre parallel to the axis of rotation of the magazine, i.e. perpendicularly to the plane of the drawing.

FIG. 6 shows with the same reference symbols as FIG. 5 the elements in the region of the magazine 25 viewed from the side, that is to say that the observer is situated substantially in the plane of the wheel. The dotted loop 39 indicates that the coil system 4 is a ring, which is closed whilst passing through the exterior of the magazine 25. The coil system 4 is introduced into the magazine before the machine is made operative whilst passing through a groove 24 in the wheel of the magazine and it is stretched so as to be firmly held at the centre of the magazine 25.

In order to start the winding operation, for example, the beginning part of the plastic tape is taken manually to the coiled bundle 4 and, for example it is fixed thereto by means of an adhesive tape. The magazine 25 is then caused to rotate in the sense of the arrow 38 so that the tape is simultaneously wound around the coil system at 27 and tape is disposed on the fly-wheel pulleys, as indicated by 26. A pincer system 40 ensures the tension of the tape. The coil system 4 is advanced synchronously in a direction indicated by the arrow 35 of FIG. 6, which leads to a helical winding operation. Of course the length of tape used for each turn around the coil system 4 is considerably shorter than that wound at 26 with the given diameter ratio. Consequently, the tape has to be cut with the cutting system 20 when the length necessary for enveloping the whole coil system 4 has been measured by the aforementioned measuring element 19. The magazine then continues to rotate and the fly-wheel pulleys rotate in themselves (in this case in the counterclockwise direction) in order to permit the tape of advancing with respect to the wheel 25.

The machine as described thus far is known and is commercially available and therefore need not be further explained. Especially the various supports and motors providing for ordinary mechanical solutions are not shown.

According to the invention, a second magazine is added to this machine for supplying and winding a bare conductive wire, which magazine is constituted advantageously in this case by a set of second fly-wheel pulleys arranged on the same axes as the first pulleys. They are shown in FIG. 6, in which the reference numerals 41 to 48 of the pulleys of FIG. 5 are repeated with an additional reference symbol "A" or "B" (only a certain number of these pulleys are represented for the sake of clarity of the Figure).

The pulleys provided with the reference symbol "A" correspond to the prior art and support the plastic tape, while those provided with the reference symbol "B" constitute the second magazine.

A coil 21 of wire 1 supplies the bare electric wire through guides 22 followed by a system analogous to that intended for the tape, in which the reference numerals 23, 29, 30 correspond to the reference numerals 18, 19 and 20, respectively.

Thus, the wire 1 and the tape 10 are wound during one and the same winding operation.

The reference numerals 1, 36, 37 of FIG. 6 for the wire correspond to the reference numerals 10, 26 and 27, respectively, for the plastic tape.

At the beginning of the winding, a few turns are made with the tape and the wire is fixed on the coiled bundle 4 only then. This procedure permits of the wire not being covered by the next turn of the tape.

What is claimed is:

1. A device for demagnetization of a picture tube of a television receiver and for earthing a conductive coating applied to the cone of the tube comprising a demagnetization coil system constituted by a bundle of insulated electric wires held together and forming at least one loop applied to the cone of the tube as well as an electrical conductor connected to earth and arranged so as to be in electrical contact with the coating, characterized in that the conductor encloses the demagnetization coiled bundle.

2. A device as claimed in claim 1, in which the wires of the bundle are held together by a sheath of plastic material enclosing them, characterized in that the conductor is constituted by the sheath itself, which is made conductive at least at the surface.

3. A device as claimed in claim 1, in which the wires of the bundle are held together by a tape of plastic material wound helically around them, characterized in that the conductor is a bare electric wire wound helically with the same pitch as the tape.

4. A device as claimed in claim 1 for a tube intended to be fixed by means of ears, with which it is provided adjacent the cone, characterized in that the bundle provided with the earthing conductor is fixed to the tube by passing in front of the ears opposite the cone.

5. A device as claimed in claim 3, provided with a connector having terminals for the electrical connection of the demagnetization coil, characterized in that the bare electric wire is also connected to one of the terminals of the connector

* * * * *